US008428483B2

(12) United States Patent
Sakatani

(10) Patent No.: US 8,428,483 B2
(45) Date of Patent: Apr. 23, 2013

(54) IMAGE FORMING APPARATUS, IMAGE FORMING SYSTEM, AND IMAGE DENSITY ADJUSTMENT METHOD

(75) Inventor: Kazuomi Sakatani, Sagamihara (JP)

(73) Assignee: Konica Minolta Business Technologies, Inc. (JP)

( * ) Notice: Subject to any disclaimer, the term of this patent is extended or adjusted under 35 U.S.C. 154(b) by 230 days.

(21) Appl. No.: 13/044,730

(22) Filed: Mar. 10, 2011

(65) Prior Publication Data

US 2011/0222868 A1 Sep. 15, 2011

(30) Foreign Application Priority Data

Mar. 12, 2010 (JP) ..... 2010-056225

(51) Int. Cl.
*G03G 15/00* (2006.01)
*G03G 15/043* (2006.01)

(52) U.S. Cl.
USPC ..... 399/72; 399/49; 399/51

(58) Field of Classification Search ..... 399/15, 399/72, 49
See application file for complete search history.

(56) References Cited

U.S. PATENT DOCUMENTS 7,483,045 B2 * 1/2009 Maetani et al. ..... 347/154
7,792,442 B2 * 9/2010 Izawa et al. ..... 399/49
2009/0092408 A1 * 4/2009 Mizes et al. ..... 399/49
2011/0222869 A1 * 9/2011 Sakatani ..... 399/15

FOREIGN PATENT DOCUMENTS

JP 5-24314 A 2/1993
JP 2007-225709 A 9/2007
JP 2007-264371 A 10/2007
JP 2007264371 A * 10/2007

* cited by examiner

*Primary Examiner* — David Gray
*Assistant Examiner* — Tyler Hardman
(74) *Attorney, Agent, or Firm* — Cantor Colburn LLP

(57) ABSTRACT

An image forming apparatus including: an image forming section; and a control section allowing the image forming section to form a belt-shaped pattern on sheets in such a way that a formation starting position of the belt-shaped pattern is shifted for a distance, obtained by dividing a measurement-distance by a number of sheets to be used, in a main-scanning direction sheet by sheet; collecting, sheet by sheet, pieces of density information each of which indicates the density of the belt-shaped pattern at a measurement position of measurement positions; creating data in which the pieces of density information respectively correspond to the measurement positions arranged in the main-scanning direction on each of the sheets; and correcting density unevenness of image data in the main-scanning direction based on the created data, wherein the image forming section forms an image based on the image data of which the density unevenness is corrected.

6 Claims, 16 Drawing Sheets

FIG.9A

FIRST SHEET

| INPUT GRADATION | MEASURED DENSITY VALUE | | | | | | |
|---|---|---|---|---|---|---|---|
| | a | b | c | ··· | q | r | MEASUREMENT POSITION |
| | a-1 | b-1 | c-1 | ··· | q-1 | r-1 | ACTUAL POSITION |
| 32 | 0.20 | 0.20 | 0.24 | ··· | 0.24 | 0.25 | |
| 64 | 0.30 | 0.30 | 0.32 | ··· | 0.32 | 0.33 | |
| 96 | 0.45 | 0.46 | 0.46 | ··· | 0.47 | 0.47 | |
| 128 | 0.62 | 0.63 | 0.64 | ··· | 0.64 | 0.65 | |
| 160 | 0.84 | 0.86 | 0.86 | ··· | 0.88 | 0.89 | |
| 192 | 1.16 | 1.17 | 1.17 | ··· | 1.18 | 1.18 | |
| 224 | 1.42 | 1.42 | 1.43 | ··· | 1.45 | 1.45 | |
| 255 | 1.67 | 1.67 | 1.68 | ··· | 1.68 | 1.69 | |

FIG.9B

SECOND SHEET

| INPUT GRADATION | MEASURED DENSITY VALUE | | | | | | |
|---|---|---|---|---|---|---|---|
| | a | b | c | ··· | q | r | MEASUREMENT POSITION |
| | a-2 | b-2 | c-2 | ··· | q-2 | r-2 | ACTUAL POSITION |
| 32 | 0.21 | 0.22 | 0.23 | ··· | 0.22 | 0.24 | |
| 64 | 0.31 | 0.29 | 0.31 | ··· | 0.33 | 0.33 | |
| 96 | 0.44 | 0.45 | 0.45 | ··· | 0.46 | 0.47 | |
| 128 | 0.62 | 0.62 | 0.63 | ··· | 0.65 | 0.65 | |
| 160 | 0.85 | 0.83 | 0.85 | ··· | 0.89 | 0.90 | |
| 192 | 1.16 | 1.17 | 1.17 | ··· | 1.19 | 1.19 | |
| 224 | 1.43 | 1.41 | 1.43 | ··· | 1.44 | 1.46 | |
| 255 | 1.67 | 1.67 | 1.67 | ··· | 1.68 | 1.68 | |

FIG.9C

THIRD SHEET

| INPUT GRADATION | MEASURED DENSITY VALUE | | | | | | |
|---|---|---|---|---|---|---|---|
| | a | b | c | ··· | q | r | MEASUREMENT POSITION |
| | a-3 | b-3 | c-3 | ··· | q-3 | r-3 | ACTUAL POSITION |
| 32 | 0.20 | 0.19 | 0.22 | ··· | 0.21 | 0.23 | |
| 64 | 0.31 | 0.31 | 0.32 | ··· | 0.33 | 0.34 | |
| 96 | 0.45 | 0.45 | 0.47 | ··· | 0.47 | 0.48 | |
| 128 | 0.61 | 0.62 | 0.63 | ··· | 0.63 | 0.64 | |
| 160 | 0.84 | 0.84 | 0.86 | ··· | 0.87 | 0.90 | |
| 192 | 1.15 | 1.14 | 1.15 | ··· | 1.17 | 1.18 | |
| 224 | 1.43 | 1.43 | 1.43 | ··· | 1.44 | 1.44 | |
| 255 | 1.68 | 1.68 | 1.69 | ··· | 1.70 | 1.70 | |

FIG.10A

| INPUT GRADATION | MEASURED DENSITY VALUE (INTERLEAVED) | | | | | | | | | | | | | | | |
|---|---|---|---|---|---|---|---|---|---|---|---|---|---|---|---|---|
| | a-1 | a-2 | a-3 | b-1 | b-2 | b-3 | c-1 | c-2 | c-3 | ··· | q-1 | q-2 | q-3 | r-1 | r-2 | r-3 |
| 32 | 0.20 | 0.21 | 0.20 | 0.20 | 0.22 | 0.19 | 0.24 | 0.23 | 0.22 | ··· | 0.24 | 0.22 | 0.21 | 0.25 | 0.24 | 0.23 |
| 64 | 0.30 | 0.31 | 0.31 | 0.30 | 0.29 | 0.31 | 0.32 | 0.31 | 0.32 | ··· | 0.32 | 0.33 | 0.33 | 0.33 | 0.33 | 0.34 |
| 96 | 0.45 | 0.44 | 0.45 | 0.46 | 0.45 | 0.45 | 0.46 | 0.45 | 0.47 | ··· | 0.47 | 0.46 | 0.47 | 0.47 | 0.47 | 0.48 |
| 128 | 0.62 | 0.62 | 0.61 | 0.63 | 0.62 | 0.62 | 0.64 | 0.63 | 0.63 | ··· | 0.64 | 0.65 | 0.63 | 0.65 | 0.65 | 0.64 |
| 160 | 0.84 | 0.85 | 0.84 | 0.86 | 0.83 | 0.84 | 0.86 | 0.85 | 0.86 | ··· | 0.88 | 0.89 | 0.87 | 0.89 | 0.90 | 0.90 |
| 192 | 1.16 | 1.16 | 1.15 | 1.17 | 1.17 | 1.14 | 1.17 | 1.17 | 1.15 | ··· | 1.18 | 1.19 | 1.17 | 1.18 | 1.19 | 1.18 |
| 224 | 1.42 | 1.43 | 1.43 | 1.42 | 1.41 | 1.43 | 1.43 | 1.43 | 1.43 | ··· | 1.45 | 1.44 | 1.44 | 1.45 | 1.46 | 1.44 |
| 255 | 1.67 | 1.67 | 1.68 | 1.67 | 1.67 | 1.68 | 1.68 | 1.67 | 1.69 | ··· | 1.68 | 1.68 | 1.70 | 1.69 | 1.68 | 1.70 |

FIG. 10B

| MINIMUM DENSITY VALUE = TARGET DENSITY VALUE |
|---|
| 0.19 |
| 0.29 |
| 0.44 |
| 0.61 |
| 0.83 |
| 1.14 |
| 1.41 |
| 1.67 |

FIG.12

| ORIGINAL INPUT GRADATION | GRADATION CORRECTION AMOUNT | | | | | | | | | | | | | | | |
|---|---|---|---|---|---|---|---|---|---|---|---|---|---|---|---|---|
| | a-1 | a-2 | a-3 | b-1 | b-2 | b-3 | c-1 | c-2 | c-3 | ··· | q-1 | q-2 | q-3 | r-1 | r-2 | r-3 |
| 32 | -1 | -2 | -1 | -1 | -3 | 0 | -5 | -4 | -3 | ··· | -5 | -3 | -2 | -6 | -5 | -4 |
| 64 | -1 | -2 | -2 | -1 | 0 | -2 | -3 | -2 | -3 | ··· | -3 | -4 | -4 | -4 | -4 | -5 |
| 96 | -1 | 0 | -1 | -2 | -1 | -1 | -2 | -1 | -3 | ··· | -3 | -2 | -3 | -3 | -3 | -4 |
| 128 | -1 | -1 | 0 | -2 | -1 | -1 | -3 | -2 | -2 | ··· | -3 | -4 | -2 | -4 | -4 | -3 |
| 160 | -1 | -2 | -1 | -3 | 0 | -1 | -3 | -2 | -3 | ··· | -5 | -6 | -4 | -6 | -7 | -7 |
| 192 | -2 | -2 | -1 | -3 | -3 | 0 | -3 | -3 | -1 | ··· | -4 | -5 | -3 | -4 | -5 | -4 |
| 224 | -4 | -5 | -5 | -4 | 0 | -2 | -2 | -2 | -2 | ··· | -4 | -3 | -3 | -4 | -5 | -3 |
| 255 | 0 | 0 | -1 | 0 | 0 | -1 | -1 | 0 | -2 | ··· | -1 | -1 | -3 | -2 | -1 | -3 |

FIG.13

| ORIGINAL INPUT GRADATION | CORRECTED INPUT GRADATION | | | | | | | | | | | | | | | |
|---|---|---|---|---|---|---|---|---|---|---|---|---|---|---|---|---|
| | a-1 | a-2 | a-3 | b-1 | b-2 | b-3 | c-1 | c-2 | c-3 | ··· | q-1 | q-2 | q-3 | r-1 | r-2 | r-3 |
| 32 | 31 | 30 | 31 | 31 | 29 | 32 | 27 | 28 | 29 | ··· | 27 | 29 | 30 | 26 | 27 | 28 |
| 64 | 63 | 62 | 62 | 63 | 64 | 62 | 61 | 62 | 61 | ··· | 61 | 60 | 60 | 60 | 60 | 59 |
| 96 | 95 | 96 | 95 | 94 | 95 | 95 | 94 | 95 | 93 | ··· | 93 | 94 | 93 | 93 | 93 | 92 |
| 128 | 127 | 127 | 128 | 126 | 127 | 127 | 125 | 126 | 126 | ··· | 125 | 124 | 126 | 124 | 124 | 125 |
| 160 | 159 | 158 | 159 | 157 | 160 | 159 | 157 | 158 | 157 | ··· | 155 | 154 | 156 | 154 | 153 | 153 |
| 192 | 190 | 190 | 191 | 189 | 189 | 192 | 189 | 189 | 191 | ··· | 188 | 187 | 189 | 188 | 187 | 188 |
| 224 | 220 | 219 | 219 | 220 | 224 | 222 | 222 | 222 | 222 | ··· | 220 | 221 | 221 | 220 | 219 | 221 |
| 255 | 255 | 255 | 254 | 255 | 255 | 254 | 254 | 255 | 253 | ··· | 254 | 254 | 252 | 253 | 254 | 252 |

IMAGE FORMING APPARATUS, IMAGE FORMING SYSTEM, AND IMAGE DENSITY ADJUSTMENT METHOD

BACKGROUND OF THE INVENTION

1. Field of the Invention

The present invention relates to an image forming apparatus, an image forming system, and an image density adjustment method.

2. Description of the Related Art

In a conventional electro-photographic image forming apparatus, density unevenness is produced in a main-scanning direction by various factors such as distortion and dirt of an electrifier which electrifies a photoreceptor, distance deviation between the photoreceptor on which a latent image is formed and a developing roller which is used for developing the formed latent image by developer such as toner, and difference of an amount of the developer carried by the developing roller.

To solve the problem, there is known a conventional image forming apparatus which outputs patches in various forms, and corrects a gradation based on values obtained by measuring the density of the patches, as described in Japanese Patent Application Laid-open Publication No. 2007-264371 and Japanese Patent Application Laid-open Publication No. 2007-225709.

As a measurement method for the outputted patches, there is known a method by which a density is measured at prescribed measurement-distance intervals, starting from a prescribed measurement starting position in the main-scanning direction, a gradation correction amount for each measurement position is calculated from a density profile obtained by the measurement, and when an image is outputted, image data corrected by the calculated gradation correction amounts is outputted so as to reduce density unevenness in the main-scanning direction.

SUMMARY OF THE INVENTION

However, even when an attempt is made to improve the accuracy of the gradation correction by increasing the number of measurement positions, the image forming apparatuses described in the Japanese Patent Application Laid-open Publications No. 2007-264371, and No. 2007-225709 cannot measure the density at shorter intervals than prescribed measurement-distance intervals. Therefore, the gradation cannot be corrected more accurately.

In order to solve at least one problem mentioned above, according to an aspect of the present invention, an image forming apparatus which forms a test pattern including a belt-shaped pattern, the image forming apparatus includes: an image forming section which forms the belt-shaped pattern on a sheet, the belt-shaped pattern which has a prescribed length extending in a main-scanning direction, and of which a density is measured at prescribed measurement-distance intervals starting from a measurement starting position corresponding to a formation starting position of the belt-shaped pattern; and a control section which allows the image forming section to form the belt-shaped pattern on a plurality of sheets in such a way that the formation starting position of the belt-shaped pattern is shifted for a distance in the main-scanning direction sheet by sheet, the distance which is obtained by dividing the measurement-distance by a number of sheets on which the belt-shaped pattern is to be formed; collects a plurality of pieces of density information sheet by sheet, the pieces of density information each of which indicates the density of the belt-shaped pattern at a measurement position of a plurality of measurement positions; creates data in which the collected pieces of density information respectively correspond to the measurement positions arranged in the main-scanning direction on each of the sheets; and corrects density unevenness of image data in the main-scanning direction based on the created data, wherein the image forming section forms an image on a sheet based on the image data of which the density unevenness is corrected.

Preferably, in the image forming apparatus, the control section allows the image forming section to form a plurality of belt-shaped patterns having gradations different from each other on a sheet, and, with regard to each of the gradations different from each other, collects the pieces of density information; creates the data; and corrects the density unevenness.

BRIEF DESCRIPTION OF THE DRAWINGS

The present invention will be understood fully from the detailed description given hereinbelow and the accompanying drawings, which are given by way of illustration only, and thus are not intended as a definition of the limits of the present invention, and wherein:

FIG. 9A is a table for explaining a density profile;

FIG. 9B is a table for explaining the density profile;

FIG. 9C is a table for explaining the density profile;

FIG. 10A is a table for explaining an interleaved density profile;

FIG. 10B is a table for explaining a target density value;

FIG. 12 is a table in which a gradation correction amount is stored; and

FIG. 13 is a table for explaining a corrected input gradation.

DESCRIPTION OF THE PREFERRED EMBODIMENT

Hereinafter, an embodiment of the present invention is described in detail referring to the accompanying drawings. However, the scope of the present invention is not limited to the drawings.

Figure 1:
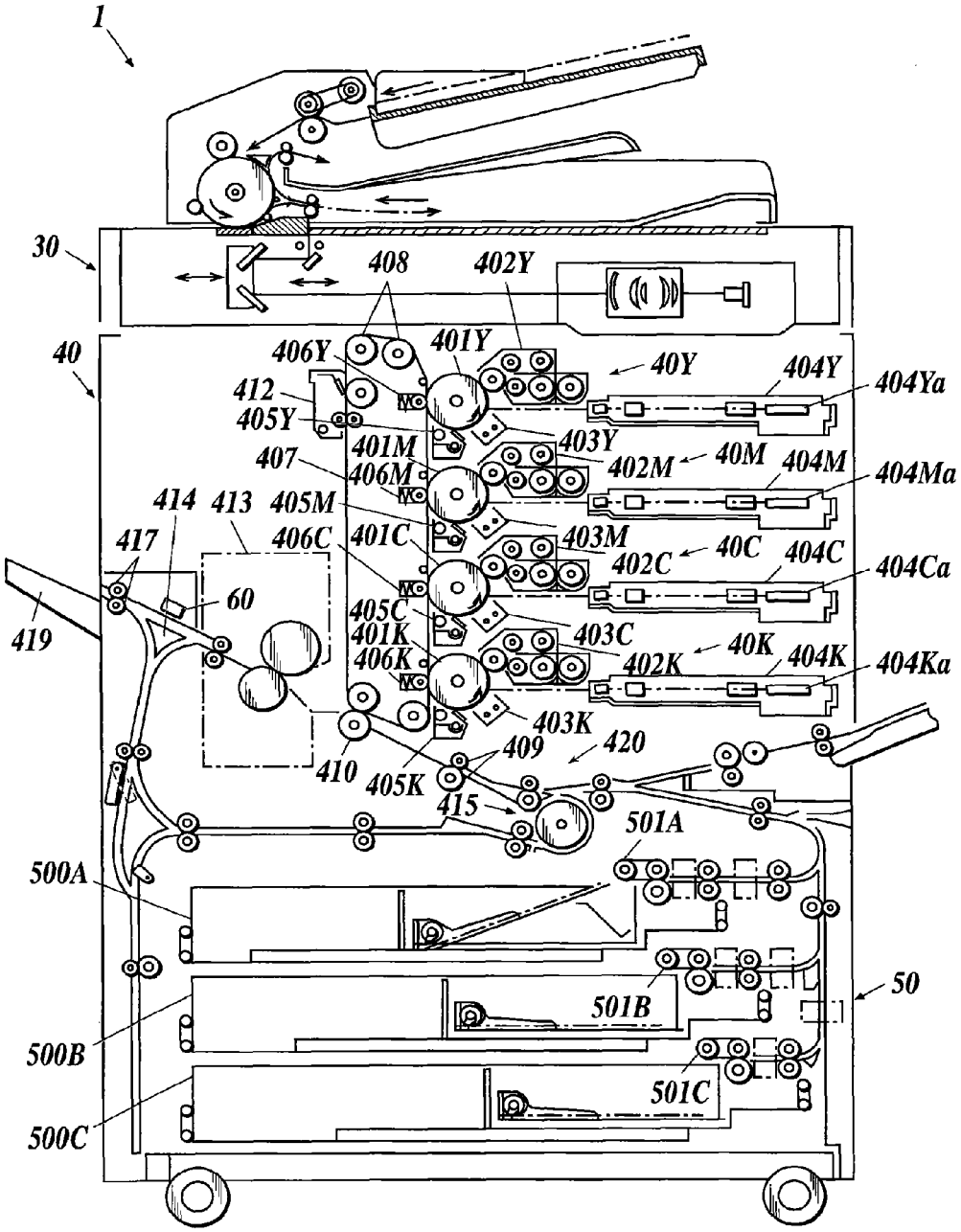
FIG. 1 shows an inner structure of an image forming apparatus according to an embodiment of the present invention.

An image forming apparatus 1 includes an image reading section 30, an image forming section 40, a sheet feeding section 50, and an image density measurement section 60 as shown in FIG. 1, for example.

The image reading section 30 includes an auto document feeder (ADF), a platen glass, a charge coupled device (CCD), and a light source. Light is emitted from the light source so as to irradiate a document which is supplied by the ADF or set at a prescribed position, and thereby the document is scanned. The CCD performs photoelectric conversion of reflected light of the light. Consequently, the image reading section 30 reads an image on the document as red (R), green (G), and blue (B) analog image signals, converts the read analog image signals into image data of R, G, and B, and outputs the image data.

The outputted image data is sent to the image forming section 40 after prescribed image processing is performed on the image data so that the image data is converted into cyan, magenta, yellow, and black (CMYK) data. In the embodiment, the image forming section 40 outputs a test pattern for gradation correction in a correction mode which is described below.

The image forming section 40 includes image forming units 40Y, 40M, 40C, and 40K, a no-end immediate transfer belt 407, a carrying section 420 which carries a sheet of paper which is fed, and a fixing section 413 which fixes a toner image transferred onto the sheet.

The image forming unit 40Y which forms an yellow (Y) image includes a photosensitive drum 401Y as an image holder, a developing device 402Y, an electrifier 403Y which is deposited in the vicinity of the photosensitive drum 401Y, a laser section 404Y, a cleaner 405Y, and a first transfer roller 406Y.

Similarly, the image forming unit 40M which forms a magenta (M) image includes a photosensitive drum 401M, a developing device 402M, an electrifier 403M, a laser section 404M, a cleaner 405M, and a first transfer roller 406M.

Similarly, the image forming unit 40C which forms a cyan (C) image includes a photosensitive drum 401C, a developing device 402C, an electrifier 403C, a laser section 404C, a cleaner 405C, and a first transfer roller 406C.

Similarly, the image forming unit 40K which forms a black (K) image includes a photosensitive drum 401K, a developing device 402K, an electrifier 403K, a laser section 404K, a cleaner 405K, and a first transfer roller 406K.

Here, an image forming operation at the image forming section 40 is described. First, in the image forming unit 40Y, the photosensitive drum 401Y is rotated, the surface of the photosensitive drum 401Y is electrified by the electrifier 403Y, and a latent image of Y image data is formed on the electrified area on the photosensitive drum 401Y by laser light outputted from the laser section 404Y, the laser light to which the electrified area is exposed. Then, the latent image is developed by the developing device 402Y, so that a Y toner image is formed. The Y toner image is transferred (first transfer) onto the intermediate transfer belt 407 by the first transfer roller 406Y and the photosensitive drum 401Y being contacted with each other by pressure. The Y toner image becomes a Y image corresponding to image data which is to be outputted. The toner which is not transferred is removed by the cleaner 405Y.

Similarly, an M toner image, a C toner image, and a K toner image are formed and transferred in the image forming units 40M, 40C, and 40K, respectively. The image forming section 40 further includes rollers 408, and a second transfer roller 410. The intermediate transfer belt 407 is rotated by the rotation of the rollers 408, the second transfer roller 410, and the first transfer rollers 406Y, 406M, 406C, and 406K. The CMYK toner images are sequently transferred onto the intermediate transfer belt 407 so as to be sequently superposed thereon by the rotation of the intermediate transfer belt 407.

The sheet feeding section 50 includes sheet feeding trays 500A, 500B, and 500C, and sheet feeding rollers 501A, 501B, and 501C for respectively carrying sheets set in the sheet feeding trays 500A, 500B, and 500C to the carrying section 420.

When images are formed on sheets by the image forming section 40, sheets are carried one by one to the carrying section 420 from any one of the sheet feeding trays 500A, 500B, and 500C by the rotation of the respective sheet feeding rollers 501A, 501B, and 501C. Then, each sheet is carried to the second transfer roller 410 by the rotation of registration rollers 409 in the carrying section 420.

When the sheet passes through a nip part of the second transfer roller 410, the CMYK toner images on the intermediate transfer belt 407 are transferred onto the sheet (second transfer). The sheet onto which the CMYK toner images are transferred passes through the fixing section 413. The CMYK toner images are fixed on the sheet by pressurization and heating at the fixing section 413, so that a color image is formed on the sheet. The sheet on which the image is formed is ejected by sheet ejection rollers 417.

When images are formed on both sides of a sheet, a sheet of which an image is formed on one side (front side) is carried into a sheet-reverse unit 415 by a carrying path changing board 414. The sheet is reversed by the sheet-reverse unit 415. Then, the sheet is carried to the second transfer roller 410 by the registration rollers 409 such that an image is formed on the other side (back side) on which an image is not formed yet. The sheet of which images are formed on both sides is ejected to a sheet ejection tray 419 by the sheet ejection rollers 417. In the embodiment, a flow path which a sheet takes by being carried by the registration rollers 409, the second transfer roller 410, the sheet-reverse unit 415, the sheet ejection rollers 417, and the like is referred to as the carrying section 420.

After an image is formed on a sheet, the toner which is left on the intermediate transfer belt 407 is removed by a belt cleaner 412. In addition, a positive current and a negative current alternatively flow from a power source (not shown) to the second transfer roller 410 for a prescribed period of time, and thereby, the toner which is left on the second transfer roller 410 is transferred back onto the intermediate transfer belt 407, and the second transfer roller 410 is cleaned accordingly.

When a sheet which passes through the fixing section 413 is sent toward the sheet ejection rollers 417 by the carrying path changing board 414, the density of a test pattern formed on the sheet is measured by the image density measurement section 60 which is deposited above the carrying section 420.

Figure 2:
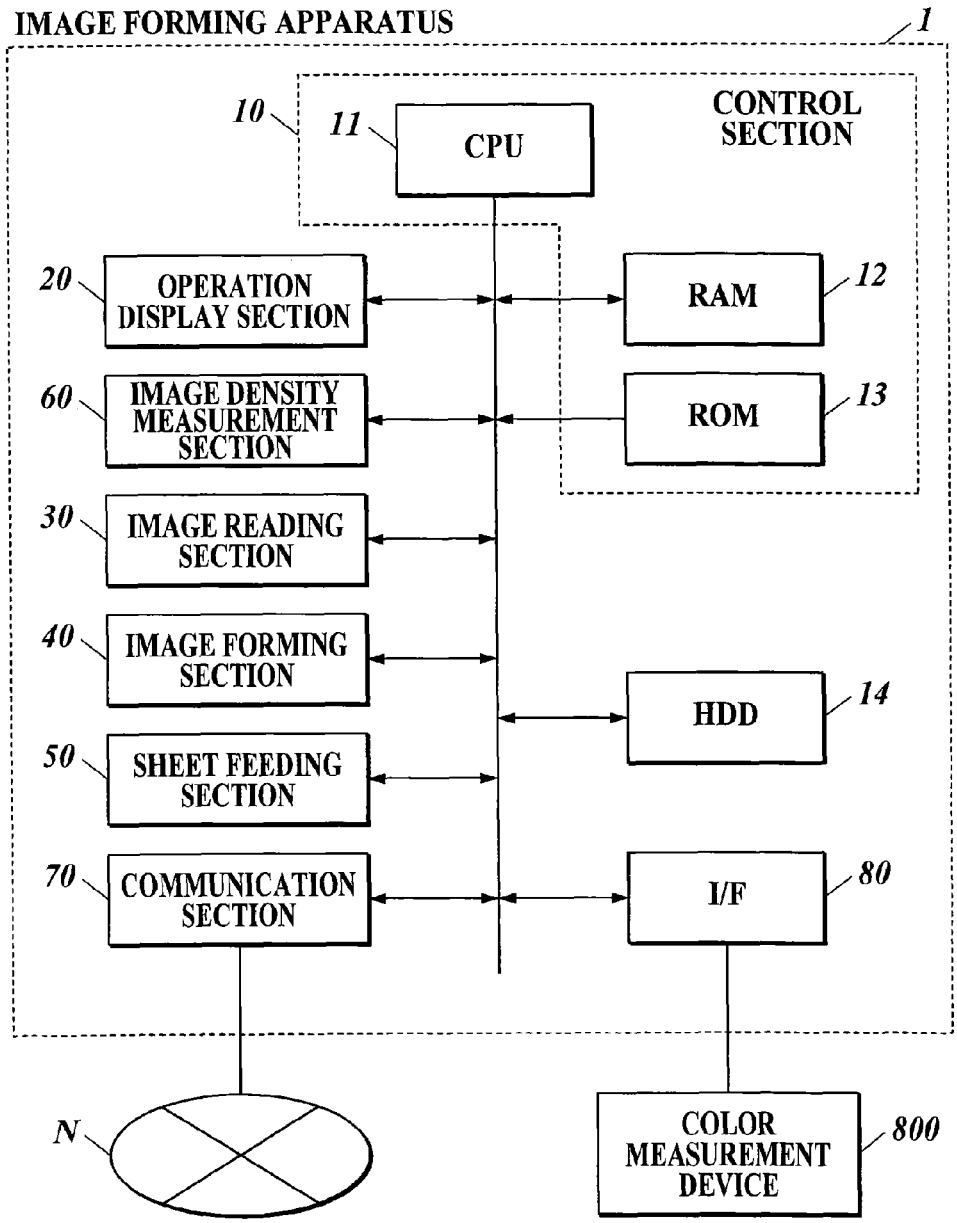
FIG. 2 is a block diagram showing a functional structure of the image forming apparatus.

Next, a control system of the image forming apparatus 1 is described. The image forming apparatus 1 includes a control section 10, a hard disk drive (HDD) 14, an operation display section 20, a communication section 70, and an interface (I/F) 80, in addition to the image reading section 30, the image forming section 40, the sheet feeding section 50, and the image density measurement section 60 as shown in FIG. 2.

The control section 10 includes a central processing unit (CPU) 11, a random access memory (RAM) 12, and a read only memory (ROM) 13. In the ROM 13, various processing programs are stored. The CPU 11 reads each of the various processing programs from the ROM 13, expands the read program in the RAM 12, and controls operations of the sections and the like of the image forming apparatus 1 according to the expanded program.

For example, when image data is inputted from the image reading section 30 or the communication section 70, the control section 10 performs various image processing on the inputted image data, and outputs the image data to the image forming section 40 page by page so as to allow the image forming section 40 to form images. The various image processing includes, for example, processing for converting RGB image data inputted from the image reading section 30 into CMYK image data, and processing for converting image data inputted from a host device (not shown) via the communication section 70 into CMYK image data by using a prescribed page description language so that the image forming apparatus 1 is capable of forming images from the image data.

The HDD 14 stores various data according to instructions from the control section 10. For example, the HDD 14 stores image data of a test pattern which is outputted in the correction mode, a table in which the gradation correction amount is stored, and the like.

The operation display section 20 includes a liquid crystal display (LCD), a touch panel, and a numeric keypad. The operation display section 20 performs displaying on the LCD by receiving display signals sent from the control section 10, and outputs operation signals inputted from the touch panel and the numeric keypad to the control section 10.

The communication section 70 is an interface which is capable of connecting to a transmission medium connected to a communication network N such as a local area network (LAN) and a wide area network (WAN). The communication section 70 is composed of, for example, a communication control card such as a LAN card, and transmits and receives various data to/from an external device such as a host device connected to the communication network N via a communication line with a LAN cable.

The I/F 80 is, for example, an interface complying with the universal serial bus (USE) standard, and is connected to a peripheral device via a prescribed cable. In the embodiment, the I/F 80 is connected to a color measurement device 800 as an image density measurement device which measures the density of an image of a test pattern formed on a sheet. In the embodiment, an image forming system includes the image forming device 1 and the color measurement device 800.

Next, a control system of the image forming section 40 is described. Since the image forming units 40Y, 40M, 40C, and 40K of the image forming section 40 have the same structure, the structure of the image forming unit 40Y is described in the following and the explanation of the other image forming units is omitted.

Figure 3:
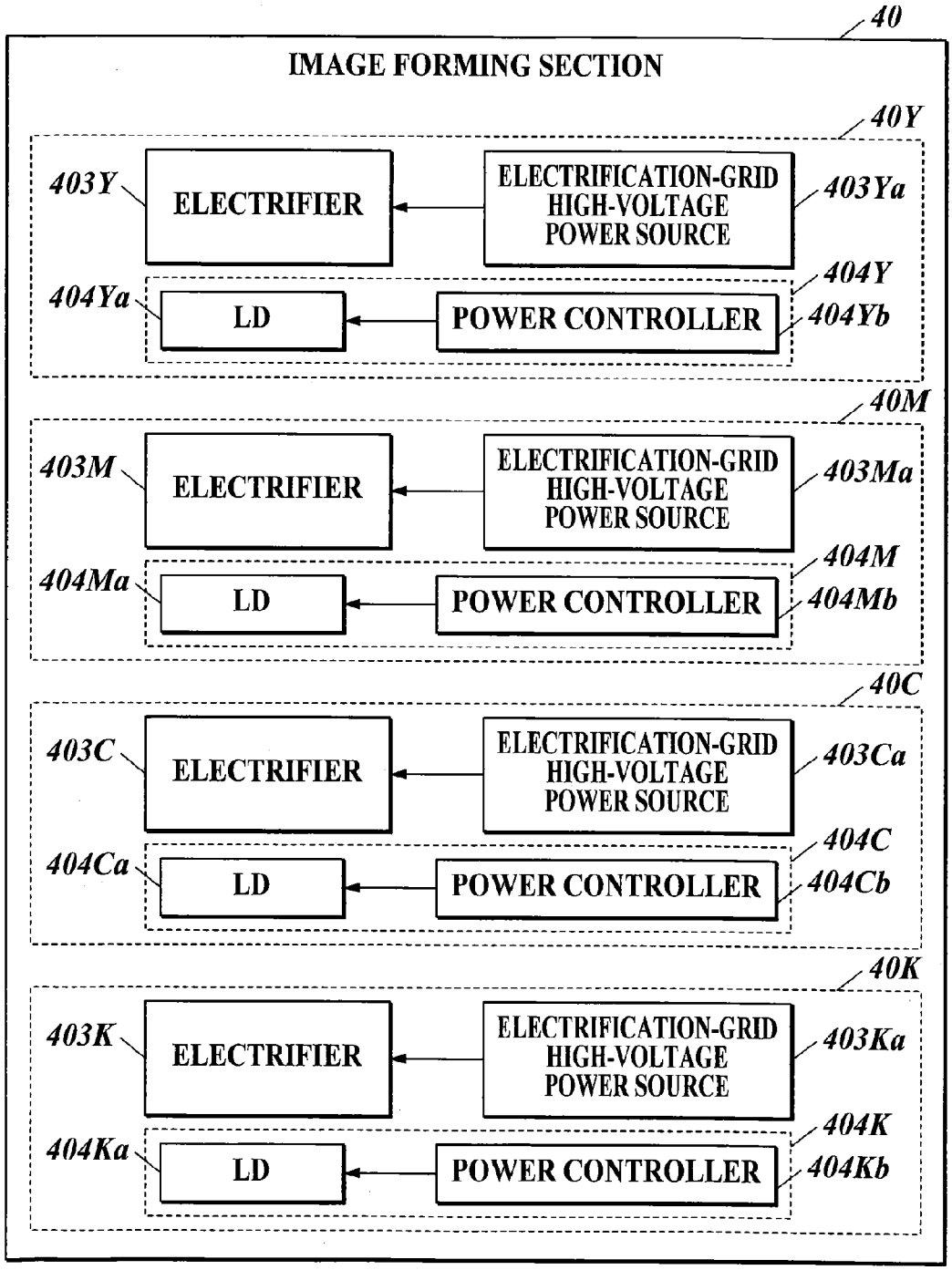
FIG. 3 is a block diagram showing a functional structure of an image forming section of the image forming apparatus.

As shown in FIG. 3, the image forming unit 40Y includes an electrification-grid high-voltage power source 403Ya. The electrification-grid high-voltage power source 403Ya is connected to the electrifier 403Y.

The electrification-grid high-voltage power source 403Ya is a power source which supplies a bias voltage to the electrifier 403Y to electrify the photosensitive drum 401Y, and outputs a voltage value of the bias voltage according to a command from the control section 10.

The laser section 404Y includes a laser diode (LD) 404Ya as a light source and a power controller 404Yb. The energy of the LD 404Ya is adjusted by the power controller 404Yb.

Another light source such as a light-emitting diode (LED) can be used instead of the LD 404Ya.

Figure 4A:
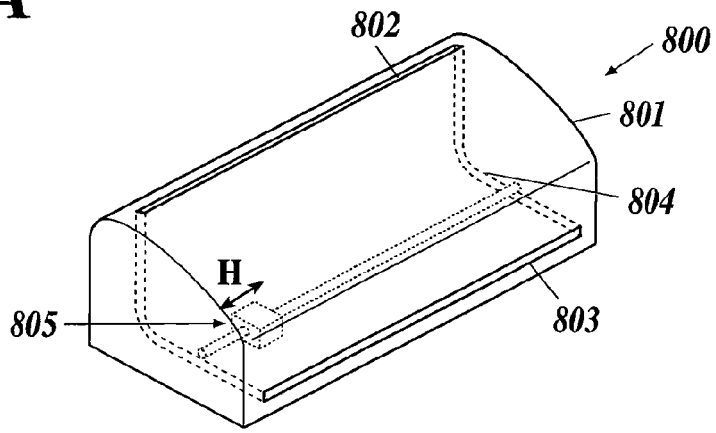
FIG. 4A shows an external appearance of a color measurement device.

Next, the external appearance of the color measurement device 800 is described referring to FIG. 4A.

As shown in FIG. 4A, the color measurement device 800 includes a color-measurement-device main body 801. A sheet insertion opening 802 is deposited at the rear part on the upper surface of the color-measurement-device main body 801, and a sheet ejection opening 803 is deposited at the lower part on the front surface thereof. In addition, a sheet carrying path 804 is deposited inside the color-measurement-device main body 801, the sheet carrying path which connects the sheet insertion opening 802 to the sheet ejection opening 803 so that sheets of paper are carried. Moreover, an image density measurement section 805 is deposited above the sheet carrying path 804 and near the sheet ejection opening 803.

Figure 4B:
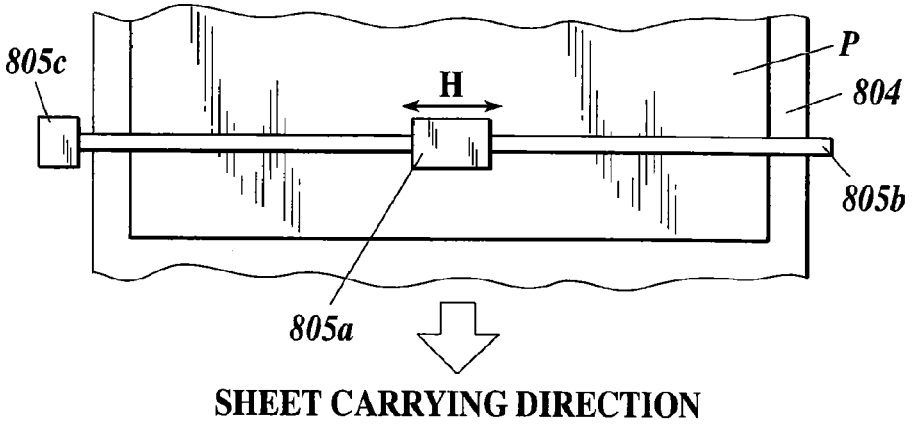
FIG. 4B is an enlarged plane view of an image density measurement section of the color measurement device.

Next, referring to FIG. 4B, the structure of the image density measurement section 805 is described. FIG. 4B is an enlarged plane view of the image density measurement section 805.

As shown in FIG. 4B, the image density measurement section 805 includes a measurement main body 805*a*, a guide shaft 805*b* which guides the measurement main body 805*a* to move in a horizontal direction H, and a driving motor 805*c* which moves the measurement main body 805*a* along the guide shaft 805*b*.

Figure 4C:
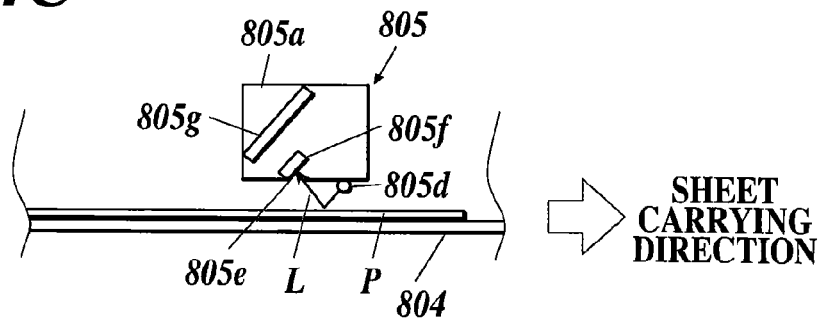
FIG. 4C is a schematic lateral view of a measurement main body of the image density measurement section.

Next, referring to FIG. 4C, the measurement main body 805*a* is described. FIG. 4C is a schematic lateral view of the measurement main body 805*a*.

The measurement main body 805*a* includes an LED 805*d* deposited at the front part on the bottom surface thereof, and is provided with an aperture 805*e* at the center of the bottom surface thereof, the aperture 805*e* into which light L outputted from the LED 805*d* and reflected by a sheet of paper P enters. In addition, the measurement main body 805*a* includes a spectroscope 805*f* which disperses the light L inputted through the aperture 805*e*, and a light receiving section 805*g* which measures the amount of the dispersed light L wavelength by wavelength.

Instead of the LED 805*d*, another light source may be used.

Furthermore, instead of dispersing the light L, an image formed on a sheet may be scanned in the main-scanning direction at a time by using a light receiving element such as a CCD.

In the color measurement device 800, when a sheet of the paper P on which a test pattern is formed is inserted into the sheet insertion opening 802, the sheet is carried by the sheet carry path 804. When the sheet carried by following the sheet carry path 804 comes under the image density measurement section 805, the image density measurement section 805 starts measurement of the density of the test pattern.

The image density measurement section 805 measures the density of the test pattern formed on the sheet in the main-scanning direction at prescribed measurement-distance intervals while reciprocating in the horizontal direction H. The measurement-distance of the image density measurement section 805 is set to be longer than the diameter of the aperture 805*e*. In the embodiment, the measurement-distance is set to a mm. Consequently, every time one image density measurement in the main-scanning direction is completed, the sheet carry path 804 carries the sheet for a prescribed distance.

Figure 6:
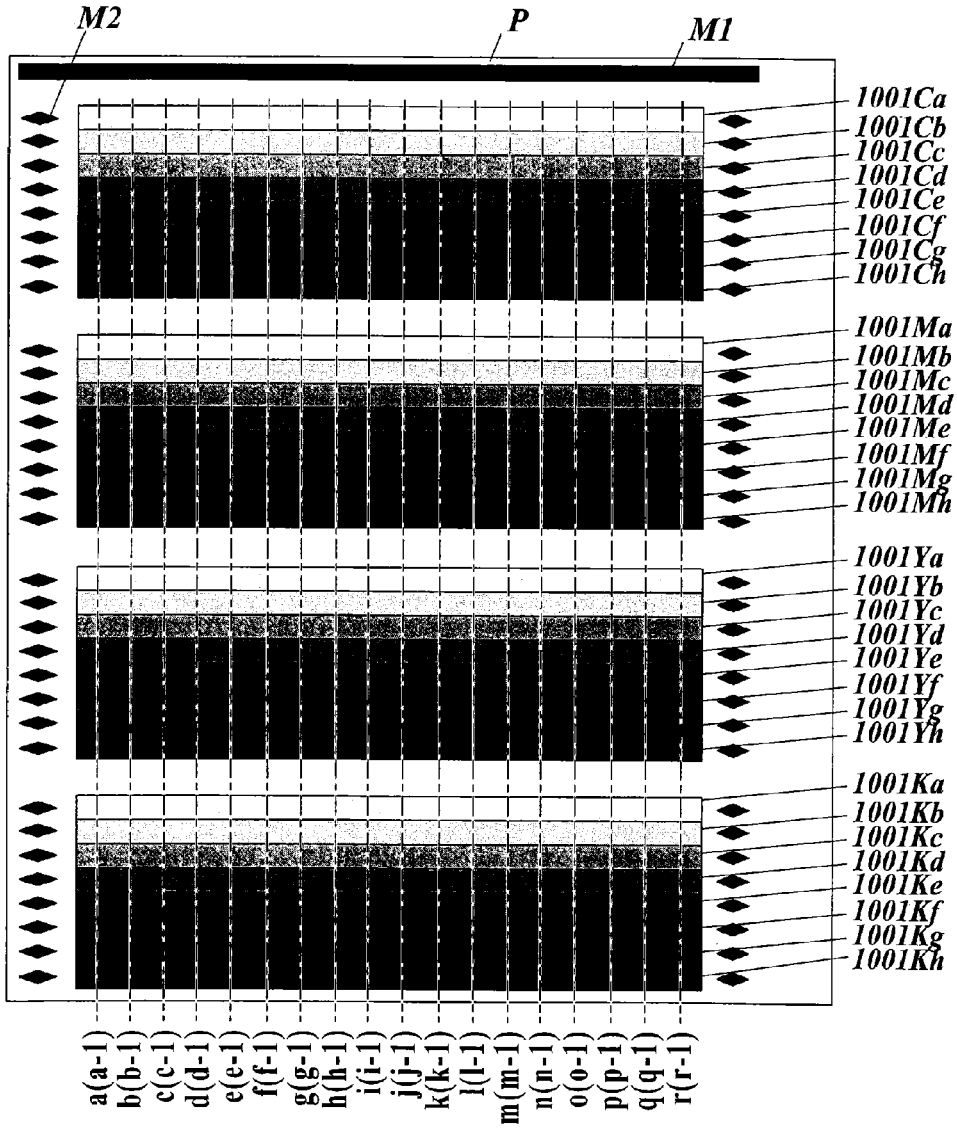
FIG. 6 shows a test pattern formed on a sheet of paper.
Figure 7:
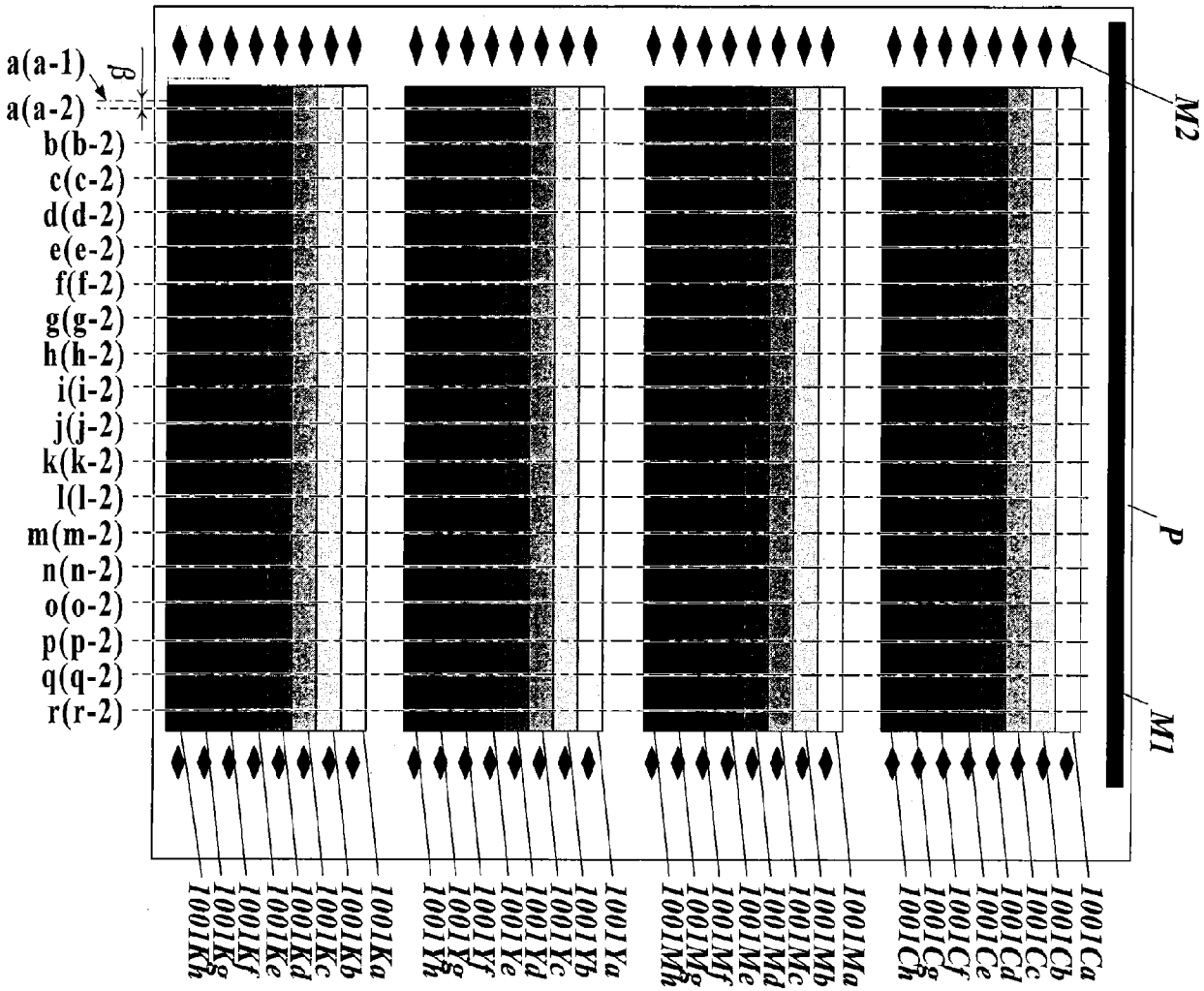
FIG. 7 shows a test pattern formed on a sheet of paper.
Figure 8:
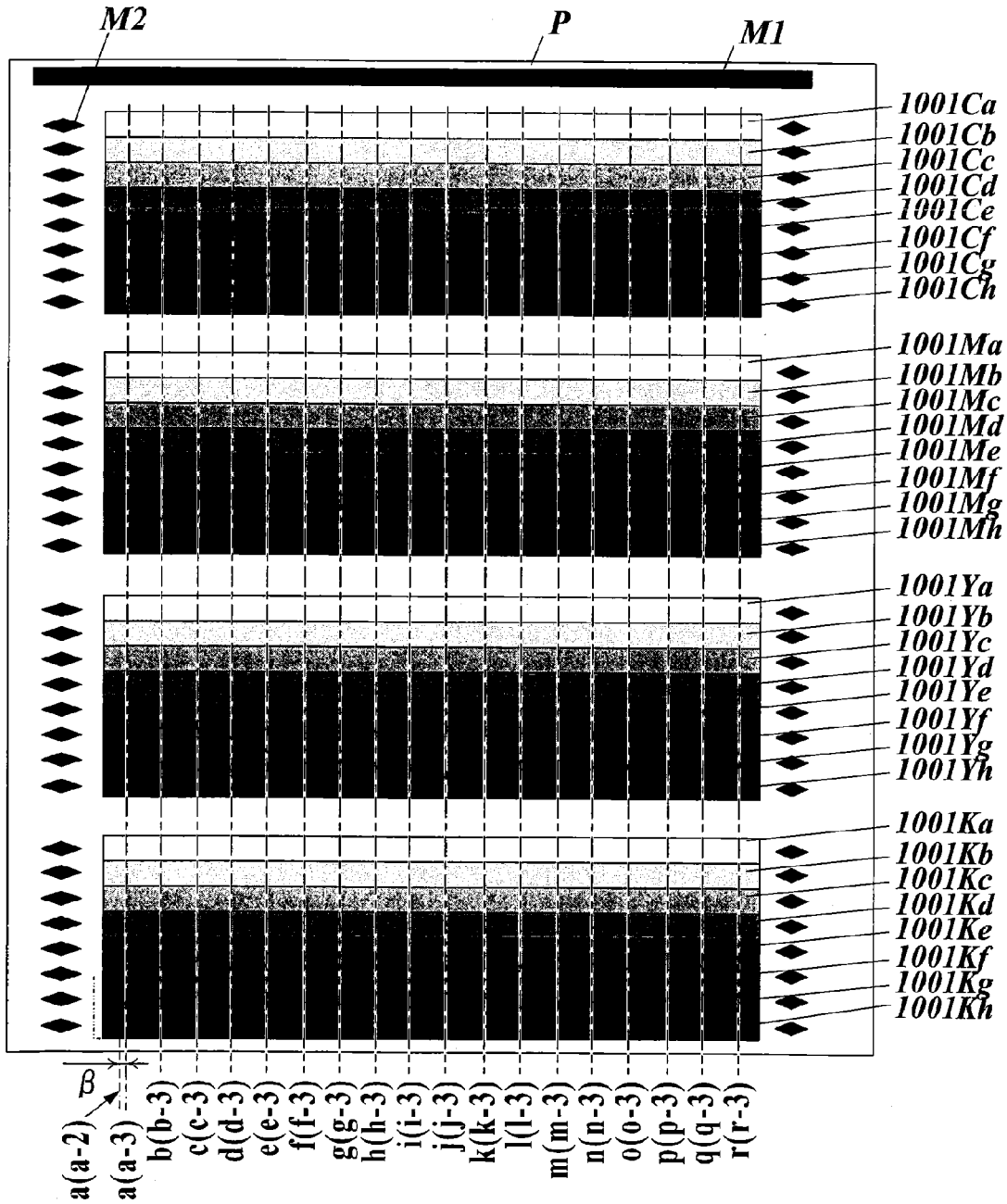
FIG. 8 shows a test pattern formed on a sheet of paper.

In each of the test patterns which are formed on the paper P, for example, a plurality of belt-shaped patterns each of which extends in the main-scanning direction is arranged in the sub-scanning direction as shown in FIGS. 6 to 8. In order to detect the density unevenness in the main-scanning direction, the belt-shaped patterns having the same gradation are formed by the image forming section 40. In the embodiment, as the paper P which is used for the image density measurement, A3 paper is used. However, it is not a limit, and hence optional paper which is suitable for the measurement can be used.

Figure 5:
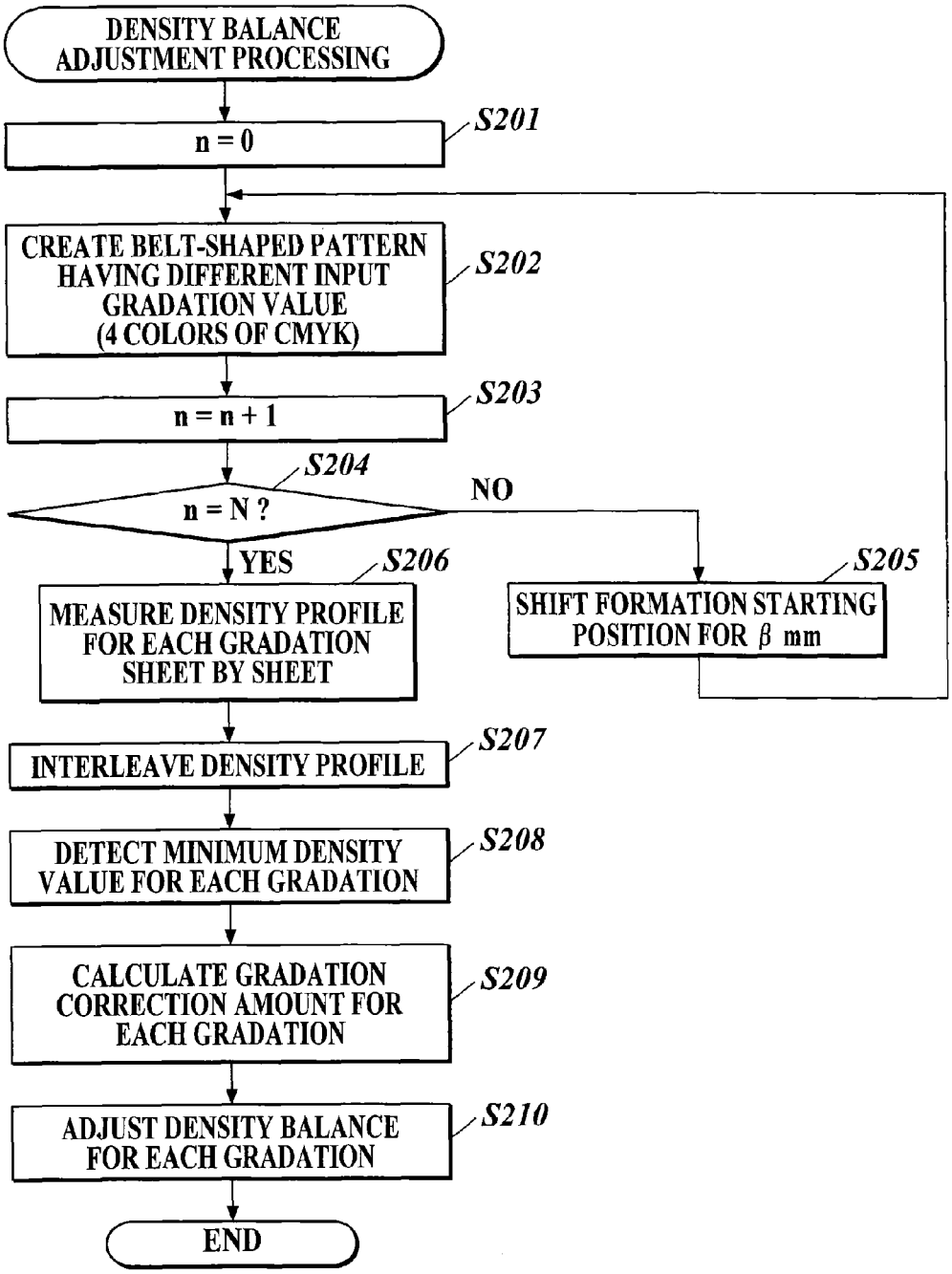
FIG. 5 is a flow chart showing steps of density balance adjustment processing.

Next, steps of density balance adjustment processing according to the embodiment of the present invention are described referring to FIG. 5.

When the control section 10 detects that a prescribed operation is performed at the operation display section 20, and shifts a mode to the correction mode, as shown in FIG. 5, the control section 10 resets a value of a counter n which indicates the number of sheets on each of which a test pattern is outputted, namely, sets 0 to the n (Step S201).

Next, the control section 10 controls the image forming section 40 to form a plurality of belt-shaped patterns which have input gradation values different from each other, for each of CMYK (Step S202). More specifically, the control section 10 controls the image forming section 40 to form a cyan belt-shaped pattern having the input gradation value of 32 (C input gradation value 32 belt-shaped pattern) 1001Ca, a cyan belt-shaped pattern having the input gradation value of 64 (C input gradation value 64 belt-shaped pattern) 1001Cb, a cyan belt-shaped pattern having the input gradation value of 96 (C input gradation value 96 belt-shaped pattern) 1001Cc, a cyan belt-shaped pattern having the input gradation value of 128 (C input gradation value 128 belt-shaped pattern) 1001Cd, a cyan belt-shaped pattern having the input gradation value of 160 (C input gradation value 160 belt-shaped pattern) 1001Ce, a cyan belt-shaped pattern having the input gradation value of 192 (C input gradation value 192 belt-shaped pattern) 1001Cf, a cyan belt-shaped pattern having the input gradation value of 224 (C input gradation value 224 belt-shaped pattern) 1001Cg, and the cyan belt-shaped pattern having the input gradation value of 255 (C input gradation value 255 belt-shaped pattern) 1001Ch in such a way that the cyan belt-shaped patterns 1001Ca to 1001Ch are sequently arranged in the sub-scanning direction as shown in FIG. 6. Similarly, the control section 10 controls the image forming section 40 to form magenta belt-shaped patterns 1001Ma to 1001Mh, yellow belt-shaped patterns 1001Ya to 1001Yh, and black belt-shaped patterns 1001Ka to 1001Kh following the cyan belt-shaped patterns 1001Ca to 1001Ch on the sheet. Here, as shown in FIG. 6, the belt-shaped patterns 1001 are formed to the left-end part on the paper P as a whole.

It is preferable that the length of each of the belt-shaped patterns 1001 be long enough to cover the width of the sheet of the paper P in the main-scanning direction, the width within which images can be formed. For example, when an image forming apparatus is capable of forming images on a sheet of A3 paper, it is preferable that belt-shaped patterns each of which has the length of about 300 mm be formed on the sheet of the A3 paper.

A start-pattern M1 shown in FIG. 6 indicates the top end of a test pattern in which a plurality of belt-shaped patterns 1001 is formed. In the embodiment, by reading the start-pattern M1 by the image density measurement section 805 of the color measurement device 800, the starting position of formation of the belt-shaped patterns 1001 in the sub-scanning direction can be easily identified.

POS markers M2 shown in FIG. 6 are patterns each of which acts as identification information which identifies the starting position of measurement of the density (measurement starting position) of each of the belt-shaped patterns 1001 in the main-scanning direction. In the embodiment, by reading the POS markers M2 by the image density measurement section 805 of the color measurement device 800, the measurement starting positions of the belt-shaped patterns 1001 in the main-scanning direction can be easily identified.

In the embodiment of the present invention, although being predetermined in order to facilitate the accurate image density measurement, the shapes, the positions, and the like of the start-pattern M1 and the POS markers M2 may be optionally set. Also, the numbers of start-patterns M1 and POS markers M2 to be arranged may be optionally set. Furthermore, it is not a requirement to provide the start-pattern M1 and the POS markers M2.

Next, the control section 10 increases a value of the counter n which indicates the number of sheets on each of which a test pattern is to be outputted (Step S203).

Then, the control section 10 judges whether the value of the counter n is equal to a prescribed number N or not (Step S204). That is, the control section 10 judges whether a prescribed number of sheets (the number of sheets to be used for the density balance adjustment) on each of which the test pattern is formed is outputted or not. In the embodiment, the prescribed number N is set to 3, for example.

When the control section 10 judges that the value of the counter n is equal to the prescribed number N (Step S204: YES), the control section 10 moves to Step S206. When the control section 10 judges that the value of the counter n is not equal to the prescribed number N (Step S204: NO), the control section 10 moves to Step S205.

The control section 10 sets a formation starting position of each belt-shaped pattern in a test pattern on a sheet which is outputted next so as to be shifted for β mm in the main-scanning direction (Step S205). The β, which is a distance for which the formation starting position is shifted, is a value obtained by dividing the measurement-distance α of the image density measurement section 805 by the prescribed number N which is the number of sheets to be used for the density balance adjustment.

The control section 10 returns to Step S202 so as to form the belt-shaped patterns on the second sheet. As shown in FIG. 7, the formation starting position of each belt-shaped pattern formed on the second sheet is shifted for β mm, namely, α/3 mm, in the main-scanning direction from the formation starting position of each belt-shaped pattern formed on the first sheet.

Similarly, the control section 10 forms the belt-shaped patterns on the third sheet. As shown in FIG. 8, the formation starting position of each belt-shaped pattern formed on the third sheet is shifted for β mm, namely, α/3 mm, in the main-scanning direction from the formation starting position of each belt-shaped pattern formed on the second sheet.

After the test pattern is formed on the first, second, and third sheets, the color measurement device 800 allows the image density measurement section 805 to measure density profiles sheet by sheet, and transmits the result of the measurement as image density information to the image forming apparatus 1 (Step S206).

The more specific explanation thereof is made referring to FIG. 6. When a sheet is carried by the sheet carry path 804, and the image density measurement section 805 reads the start mark M1 so that the starting position of a test pattern is recognized, the color measurement device 800 carries the sheet and moves the image density measurement section 805 in such a way that the image density measurement section 805 is above a POS marker M2 among the plurality of POS markers M2 formed on the sheet, the POS marker M2 which is a top POS marker M2 on the left side on the sheet (left-top POS marker M2). When the image density measurement section 805 reads the left-top POS marker M2, the color measurement device 800 moves the image density measurement section 805 to the measurement starting position (measurement position a) to which there is a prescribed distance from the left-top POS marker M2 in the main-scanning direction. Thereafter, the color measurement device 800 allows the image density measurement section 805 to measure the density of the belt-shaped pattern 1001Ca at the measurement position a thereon, the belt-shaped pattern 1001Ca which is arranged so as to be in line with the left-top POS marker M2 in the main-scanning direction. Then, the color measurement device 800 moves the image density measurement section 805 for the prescribed measurement-distance α, so that the image density measurement section 805 also measures the density at the measurement positions b to r. The a to r in FIG.

6 indicate the measurement positions in relation to the POS markers M2. When a POS marker M2 at the top on the right side is read by the image density measurement section 805, the color measurement device 800 moves the image density measurement section 805 to a POS marker M2 on the second row on the left side. Similarly, the color measurement device 800 allows the image density measurement section 805 to measure the density of the belt-shaped pattern 1001Cb at each of the measurement positions a to r thereon, thereafter. The color measurement device 800 performs this operation with regard to all the belt-shaped patterns 1001Ca to 1001Ch, 1001Ma to 1001Mh, 1001Ya to 1001Yh, and 1001Ka to 1001Kh formed on the sheet.

Similarly, the color measurement device 800 measures the density of each of the belt-shaped patterns 1001 on the second and third sheets. The belt-shaped patterns 1001 on the second sheet and the belt-shaped patterns 1001 on the third sheet are formed so as to be respectively shifted for $\alpha/3$ mm and $2\alpha/3$ mm in the main-scanning direction from the belt-shaped patterns 1001 on the first sheet. Consequently, the positional relationship of the measurement positions a to r to the POS markers M2 is the same on any one of the sheets. However, the measurement positions a to r are arranged at different positions on each of the sheets when the sheets are compared with each other. In order to show the positional relationship of the measurement positions to each of the sheets, the measurement positions a to r on the first, second, and third sheets are also indicated as the measurement positions a-1 to r-1 on the first sheet shown in FIG. 6, as the measurement positions a-2 to r-2 on the second sheet shown in FIG. 7, and as the measurement positions a-3 to r-3 on the third sheet shown in FIG. 8.

As shown in FIGS. 9A to 9C, the color measurement device 800 obtains the measured density values of the belt-shaped patterns 1001 at the measurement positions a to r on the first, second, and third sheets. The measured density values shown in FIGS. 9A to 9C are the measured density values of the black belt-shaped patterns 1001. The measured density values of the other colors' belt-shaped patterns 1001 are also obtained similarly.

The color measurement device 800 transmits the image density information sheet by sheet, the image density information which shows the measured density values of the belt-shaped patterns 1001 at the measurement positions a to r, to the image forming apparatus 1, the measured density values which are measured in the above-described manner.

Figure 11:
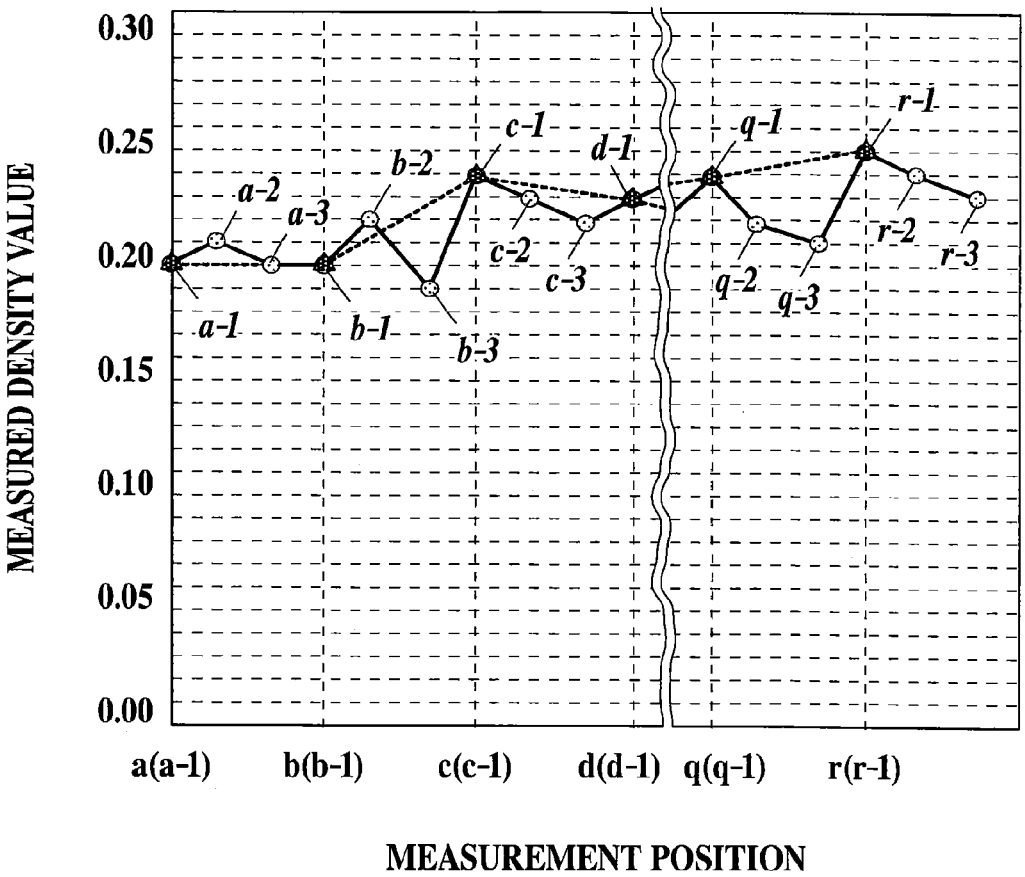
FIG. 11 is a graph showing a measured density value to an input gradation.

Next, the control section 10 of the image forming apparatus 1 interleaves, based on the image density information, the density profiles, namely, the measured density values, of the belt-shaped patterns 1001 at the measurement positions a to r on the sheets so that the density profiles on the sheets are expanded on one table (Step S207). More specifically, the control section 10 expands the measured density values of the belt-shaped patterns 1001 at the measurement positions a to r on the sheets on a prescribed table in such a way that the positional relationship of the measurement positions a to r to each of the sheets is identified. Consequently, with regard to the black belt-shaped patterns 1001Ka to 1001Kh, the table shown in FIG. 10A is obtained. The measured density values expanded in the table can be expressed by a graph. For example, the measured density values of the black input gradation value 32 belt-shaped pattern 1001Ka can be expressed by the graph shown in FIG. 11. In FIG. 11, the vertical axis indicates the measured density values, and the horizontal axis indicates the measurement positions. In addition, in FIG. 11, the solid line plotted with circles indicates the measured density values obtained by using three sheets in the embodiment, and the circles indicate the measurement positions. Moreover, in FIG. 11, the broken line plotted with triangles indicates the measured density values obtained by using only one sheet, and the triangles indicate the measurement positions. As it is obvious by FIG. 11, according to the measurement result, the density of the K input gradation value 32 belt-shaped pattern 1001Ka are different from measurement position to measurement position. That is, the density unevenness is produced. The factor which may produce the density unevenness is, for example, that an electrification grid of an electrifier is contaminated by toner or ozone, and consequently, the voltage on the photosensitive drum becomes different from position to position on the photosensitive drum. Furthermore, density gradient is regarded as one of density unevenness. The density gradient is produced by difference of amount of developer to be carried. It is because that a rotation shaft of a developing roller of a developing device and a rotation shaft of a photosensitive drum are not completely in parallel, thereby, distance deviation between the developing roller and the photosensitive drum is produced.

As it is obvious by FIG. 11, according to the embodiment, a more detailed measurement result can be obtained by measuring the density by using three sheets as compared with a measurement result obtained by measuring the density by using only one sheet. The same process is performed for the cyan, magenta, and yellow belt-shaped patterns 1001.

Next, the control section 10 detects the minimum density value which indicates the minimum density based on the table obtained at Step S207 for each color and gradation (Step S208). More specifically, the control section 10 compares the interleaved measured density values at the measurement positions a-1 to r-3 shown in FIG. 10A with each other for each color and gradation so as to detect the minimum density value for each color and gradation. As for the black belt-shaped patterns 1001, the minimum density value for each gradation is shown by shading in FIG. 10A. The minimum density values of the black input gradation values 32, 64, 96, 128, 160, 192, 224, and 255 belt-shaped patterns 1001Ka to 1001Kh are 0.19 at the measurement position b-3, 0.29 at the measurement position b-2, 0.44 at the measurement position a-2, 0.61 at the measurement position a-3, 0.83 at the measurement position b-2, 1.14 at the measurement position b-3, 1.41 at the measurement position b-2, and 1.67 at the measurement position a-1, respectively. As shown in FIG. 10B, the minimum density value for each gradation is used as the target density value for each gradation at Step S208 described below.

Next, the control section 10 obtains, for each gradation and color, a difference between each of the measured density values shown in FIG. 10A and its minimum density value detected at Step S208, the minimum density value which is the target density value, and calculates a gradation correction value based on the difference (Step S209). More specifically, the control section 10 obtains a difference between the target density value and each of the measured density values which respectively correspond to the measurement positions a-1 to r-3. Then, the control section 10 creates a table by which an original input gradation is changed by 1 when the difference is 0.01. For example, when the difference between the measured density value and the target density value (a measured density value minus a target density value) is +0.03, the amount of correction of a gradation (gradation correction amount) is set to −3, and the gradation correction amount is stored in the table. In this manner, the control section 10 creates, for example, the table shown in FIG. 12, the table in which the gradation correction amounts are set with regard to the black belt-shaped patterns 1001Ka to 1001Kh, and the table is stored in the RAM 12, the HDD 14, or the like. Similarly, the control section 10 creates tables on which the gradation correction amounts are set for cyan, magenta, and yellow.

When image data is inputted from the image reading section 30, a host device, or the like, the control section 10 refers to the table created at Step S209, and adjusts the density balance for each gradation (Step S210). More specifically, with regard to the inputted image data, the control section 10 refers to the table, and reads, therefrom, a gradation correction amount corresponding to the input gradation (original input gradation) for each position where an image is outputted. Next, the control section 10 calculates a corrected input gradation from the read gradation correction value so as to correct the gradation. Then, the control section 10 adjusts the density balance by performing control under which an image is formed on a sheet by using the corrected input gradation. For example, when a black image is formed, the image is formed by using the corrected input gradations shown in FIG. 13. When the original input gradation is 255, and the corrected input gradation is less than 255, the control section 10 adjusts the gradation by half-toning suitable to the corrected input gradation. Similarly, with regard to each of cyan, magenta, and yellow, the input gradation is corrected, and then an image is formed based thereon.

Thus, in the embodiment of the present invention, the belt-shaped patterns 1001 are formed on a plurality of sheets in such a way that the formation starting position thereof is shifted sheet by sheet, and the color measurement device 800 measures the density of the belt-shaped patterns 1001. Accordingly, by using the color measurement device of which the measurement-distance is predetermined, the density balance can be adjusted with higher resolution.

Furthermore, in the embodiment, a spike-like striped noise and the like which are density unevenness having a relatively high frequency can be detected easily by increasing the number of measurement positions, the spike-like striped noise and the like which appear on a sheet, for example, owing to scratches on the surface of the photosensitive drums and/or on the surface of the developing rollers of the developing devices. Accordingly, a proper density balance adjustment can be performed on such density unevenness too.

As described above, according to the embodiment of the present invention, the image forming section 40 forms a belt-shaped pattern 1001 on a sheet. The control section 10 allows the image forming section 40 to form the belt-shaped pattern 1001 on a plurality of sheets in such a way that the formation starting position of the belt-shaped pattern is shifted for a distance β in the main-scanning direction sheet by sheet, the distance β which is obtained by dividing the measurement-distance α by a number of sheets of the paper P on which the belt-shaped pattern 1001 is to be formed. Then, the control section 10 collects a plurality of pieces of density information sheet by sheet, the pieces of density information each of which indicates the density of the belt-shaped pattern 1001 at a measurement position of a plurality of measurement positions. Thereafter, the control section 10 creates data in which the collected pieces of density information respectively correspond to the measurement positions arranged in the main-scanning direction on the sheet. Then, the control section 10 corrects density unevenness of image data in the main-scanning direction based on the created data. The image forming section 40 forms an image on a sheet based on the image data of which the density unevenness is corrected. Consequently, the number of measurement positions is increased, and hence the density balance can be adjusted more accurately.

According to the embodiment of the present invention, the control section 10 allows the image forming section 40 to form the belt-shaped patterns (1001Ya to 1001Yh, 1001Ma to 1001Mh, 1001Ca to 1001Ch, and 1001Ka to 1001Kh) having gradations different from each other (input gradations 32, 64, 96, 128, 160, 192, 224, and 255) on sheets of the paper P, and, with regard to each of the gradations, collects the plurality of density information sheet by sheet, creates the data, and corrects density unevenness. Consequently, the density balance can be adjusted gradation by gradation, and hence, the accuracy of the density balance adjustment can be further improved.

According to the embodiment of the present invention, the image forming apparatus 1 includes the image forming section 40 which forms a belt-shaped pattern 1001 on a sheet of the paper P, the belt-shaped pattern 1001 having a prescribed length extending in a main-scanning direction, and the control section 10 which performs control regarding image formation. The color measurement device 800 receives the sheet of the paper P on which the belt-shaped pattern 1001 is formed by the image forming section 40, measures the density of the belt-shaped pattern 1001 at prescribed measurement-distance α intervals staring from the measurement starting position (measurement position a) corresponding to the formation starting position of the belt-shaped pattern 1001. Thereafter, the color measurement device 800 outputs a result of the measurement. The control section 10 allows the image forming section 40 to form the belt-shaped pattern 1001 on a plurality of sheets in such a way that the formation starting position of the belt-shaped pattern 1001 is shifted for the distance β in the main-scanning direction sheet by sheet, the distance β which is obtained by dividing the measurement-distance α by a number of sheets on which the belt-shaped pattern 1001 is to be formed. Then, the control section 10 collects a plurality of pieces of density information sheet by sheet, the pieces of density information each of which indicates the density of the belt-shaped pattern 1001 at a measurement position of a plurality of measurement positions (a-1, to r-1, a-2 to r-2, and a-3 to r-3). Then, the control section 10 creates data in which the pieces of density information respectively correspond to the measurement positions arranged in the main-scanning direction on each of the sheets. After that, the control section 10 corrects density unevenness of image data in the main-scanning direction based on the created data. The image forming section 40 forms an image on a sheet based on the image data of which the density unevenness is corrected. Consequently, the number of measurement positions increased, and hence the density balance can be adjusted more accurately.

According to the embodiment of the present invention, the control section 10 allows the image forming section 40 to form a POS marker M2 with the belt-shaped pattern 1001 on each of the sheets of the paper P, the POS marker M2 which identifies the measurement starting position (measurement position a). The color measurement device 800 determines the measurement starting position (measurement position a) of the belt-shaped pattern 1001 formed on each of the sheets of the paper P when reading the POS marker M2 formed on each of the sheets of the paper P. Since the measurement starting position can be easily identified, each measurement position can also be easily and accurately identified. Consequently, the density can be measured more accurately.

The embodiment is an example of the image forming apparatus and the image forming system of the present invention, and hence is not intended to limit the scope of the present invention. The detailed structures and the detailed operations of the sections and the like of the image forming apparatus and the image forming system of the present invention can be appropriately changed.

In the embodiment, the density balance is adjusted by using three sheets. That is, a test pattern is outputted on three sheets in such a way that the test pattern is shifted in the main-scanning direction for a distance sheet by sheet, the distance which is obtained by dividing the measurement-distance of the image density measurement section 805 of the color measurement device 800 by the number of sheets to be used, the measurement results are interleaved, and the density balance is adjusted based the interleaved measurement result. However, the number of sheets to be used can be optionally set. The more sheets are used, the shorter the actual measurement-distance becomes, so that the accuracy of the correction can be improved.

The measurement-distance can be determined as needed according to the specification of an apparatus which measures the density of images. As the density is measured at shorter intervals, the measurement positions can be more. Consequently, the density balance can be adjusted more accurately.

In the embodiment, a test pattern is outputted on a plurality of sheets in such a way that the test pattern is shifted for a distance in the main-scanning direction sheet by sheet, and the result of the measurement is interleaved, and thereby the density balance is adjusted. However, the density balance may be measured by performing the image density measurement according to the embodiment multiple times, and obtaining the average of the measurement results. Consequently, the density unevenness of the belt-shaped patterns, the density unevenness which is produced each time the test pattern is outputted, can converge, and hence, the accuracy of the correction can be further improved.

In the embodiment, the density balance may be adjusted after an overall image density is adjusted by changing the image-forming process condition. As for the method for changing the image-forming process condition, when the image-forming process condition for forming a black image is changed, the following method can be used, the method by which the control section 10 controls the image forming section 40 to change a bias voltage of the electrification-grid high-voltage power supply 403Ka of the image forming unit 40K shown in FIG. 3, and adjusts the voltage built up on the photosensitive drum 401K via the electrifier 403K. The density can be increased, for example, by increasing the bias voltage of the electrification-grid high-voltage power supply 403Ka so as to increase the voltage on the photosensitive drum 401K. For example, in order to increase the measured density value from 1.67 to 1.68, the control section 10 controls the image forming section 40 to increase the bias voltage of the electrification-grid high-voltage power supply 403Ka by 10 V. Consequently, the density can be increased.

As another way, for example, the control section 10 controls the image forming section 40 in such a way that the power controller 404Kb adjusts exposure energy of the LD 404Ka. As an exposure energy adjustment method, changing an output pulse width, changing an output voltage, and the like can be used. For example, the density can be increased by increasing the exposure energy of the LD 404Ka so as to make the voltage on an exposed area of the photosensitive drum 401K further lower.

The image-forming process condition may be changed by both changing the bias voltage of the electrification-grid high-voltage power source and adjusting the exposure energy of the LD. By taking any of the above-described ways, the overall image density can be adjusted.

Furthermore, it is possible that a test pattern is outputted, the image-forming process condition is changed to obtain a desired measured density value, and then the test patter is outputted again so as to adjust the density balance. Consequently, the reliability of the density balance adjustment can be increased.

In the embodiment, when the density balance is adjusted between the measurement positions, for example, a gradation correction amount at between the measurement positions may be obtained by interpolation processing based on the gradation correction amounts obtained as described above. For the interpolation processing, for example, linear interpolation, polynomial interpolation, spline interpolation, and the like can be used.

In the embodiment, the density balance is adjusted by outputting, for each color, the belt-shaped patterns having gradations different from each other. However, the above-described density balance adjustment may be performed by only outputting, for each color, the belt-shaped patterns having a specific gradation (the maximum gradation, for example) on a plurality of sheets. For example, when the density balance is adjusted by using only the belt-shaped patterns having the maximum gradation, measured density values of the other gradations can be obtained from the measured density values of the belt-shaped patterns having the maximum gradation (255) by multiplying each of the measured density values thereof by a prescribed coefficient, and gradation correction values of the other gradations can be calculated based thereon. It is also possible that the gradation correction values for the maximum gradation is calculated from the measured density values of the belt-shaped patterns having the maximum gradation (255), and the gradation correction values for the maximum gradation is used as the gradation correction values for the other gradations.

In the embodiment, the density of each belt-shaped pattern is measured by the color measurement device 800, but may be measured by the image forming apparatus 1. For example, the density balance may be adjusted by applying the configuration of the image density measurement section 805 of the color measurement device 800 to the image density measurement section 60 of the image forming apparatus 1. Furthermore, it is possible that the image forming apparatus 1 is provided with an optional device having an image density measurement section by being connected with each other, and the optional device measures the density of belt-shaped patterns formed on a sheet by receiving the sheet which is ejected from the image forming apparatus 1.

The input values of the gradations (input gradation values) of the belt-shaped patterns which are subjects to the density measurement may be different from the values used in the embodiment, and hence can be optionally set.

In the embodiment, for each gradation, the minimum density value is detected, and the gradation correction value for each measurement position is set in such a way that a measured density value at a measurement position becomes the minimum density value. However, this is not a limit, and hence, other density balance adjustment methods may be used. For example, it is possible that, for each gradation, the average of measured density values measured at their respective measurement positions is calculated, and the gradation correction value for each measurement position is set in such a way that a measured density value at a measurement position becomes the average of the measured density values.

In the embodiment of the present invention, the image forming apparatus which performs four color printing is used.

However, the present invention can be also applied to an image forming apparatus which performs single color printing.

In the embodiment of the present invention, a HDD, a semiconductor nonvolatile memory, or the like is used for the computer readable recording medium which stores the programs of the present invention. However, this is not a limit. For example, a portable recording medium such as a CD-ROM can be used for the computer readable recording medium. Furthermore, a carrier wave can be used as a medium which provides the data of the programs of the present invention via a communication line.

This application is based upon and claims the benefit of priority from the prior Japanese Patent Application No. 2010-056225, filed on Mar. 12, 2010, and the entire contents thereof are incorporated herein by reference.

What is claimed is:

1. An image forming apparatus which forms a test pattern including a belt-shaped pattern, the image forming apparatus comprising:

an image forming section which forms the belt-shaped pattern on a sheet, the belt-shaped pattern which has a prescribed length extending in a main-scanning direction, and of which a density is measured at prescribed measurement-distance intervals starting from a measurement starting position corresponding to a formation starting position of the belt-shaped pattern; and a control section which allows the image forming section to form the belt-shaped pattern on a plurality of sheets in such a way that the formation starting position of the belt-shaped pattern is shifted for a distance in the main-scanning direction sheet by sheet, the distance which is obtained by dividing the measurement-distance by a number of sheets on which the belt-shaped pattern is to be formed; collects a plurality of pieces of density information sheet by sheet, the pieces of density information each of which indicates the density of the belt-shaped pattern at a measurement position of a plurality of measurement positions; creates data in which the collected pieces of density information respectively correspond to the measurement positions arranged in the main-scanning direction on each of the sheets; and corrects density unevenness of image data in the main-scanning direction based on the created data, wherein the image forming section forms an image on a sheet based on the image data of which the density unevenness is corrected.

2. The image forming apparatus according to claim 1, wherein the control section allows the image forming section to form a plurality of belt-shaped patterns having gradations different from each other on a sheet, and, with regard to each of the gradations different from each other, collects the pieces of density information; creates the data; and corrects the density unevenness.

3. An image forming system comprising:

an image forming apparatus including:

an image forming section which forms a belt-shaped pattern on a sheet, the belt-shaped pattern having a prescribed length extending in a main-scanning direction; and a control section which performs control regarding image formation, and a color measurement device which receives the sheet on which the belt-shaped pattern is formed by the image forming section, measures a density of the belt-shaped pattern at prescribed measurement-distance intervals staring from a measurement starting position corresponding to a formation starting position of the belt-shaped pattern formed on the sheet, and outputs a result of the measurement, wherein the control section allows the image forming section to form the belt-shaped pattern on a plurality of sheets, and allows the image forming section to form the belt-shaped pattern on a plurality of sheets in such a way that the formation starting position of the belt-shaped pattern is shifted for a distance in the main-scanning direction sheet by sheet, the distance which is obtained by dividing the measurement-distance by a number of sheets on which the belt-shaped pattern is to be formed; collects a plurality of pieces of density information sheet by sheet, the pieces of density information each of which indicates the density of the belt-shaped pattern at a measurement position of a plurality of measurement positions; creates data in which the pieces of density information respectively correspond to the measurement positions arranged in the main-scanning direction on each of the sheets; and corrects density unevenness of image data in the main-scanning direction based on the created data, and the image forming section forms an image on a sheet based on the image data of which the density unevenness is corrected.

4. The image forming system according to claim 3, wherein the control section allows the image forming section to form identification information with the belt-shaped pattern on each of the sheets, the identification information which identifies the measurement starting position, and the color measurement device determines the measurement starting position of the belt-shaped pattern formed on each of the sheets when reading the identification information formed on each of the sheets.

5. An image density adjustment method comprising:

forming a belt-shaped pattern on a plurality of sheets, the belt-shaped pattern having a prescribed length extending in a main-scanning direction, in such a way that a formation starting position of the belt-shaped pattern is shifted for a prescribed distance in the main-scanning direction sheet by sheet;

measuring a density of the belt-shaped pattern formed on each of the sheets at prescribed measurement-distance intervals starting from a measurement starting position of the belt-shaped pattern, the measurement starting position corresponding to the formation starting position;

collecting a plurality of pieces of density information sheet by sheet, the pieces of density information each of which indicates the measured density of the belt-shaped pattern at a measurement position of a plurality of measurement positions;

creating data in which the collected pieces of density information respectively correspond to the measurement positions arranged in the main-scanning direction on each of the sheets; and correcting density unevenness of image data in the main-scanning direction based on the created data, wherein in the forming, the belt-shaped pattern is formed on the sheets in such a way that the formation starting position of the belt-shaped pattern is shifted for the distance in the main-scanning direction sheet by sheet, the distance which is obtained by dividing the measurement-distance by a number of sheets on which the belt-shaped pattern is to be formed.

6. The image density adjustment method according to claim 5, wherein in the forming, identification information is formed with the belt-shaped pattern on each of the sheets, the identification information which identifies the measurement starting position, and in the measuring, the measurement starting position of the belt-shaped pattern formed on each of the sheets is determined by reading the identification information formed on each of the sheets.

* * * * *